US007175487B2

(12) United States Patent
Urbaniak et al.

(10) Patent No.: US 7,175,487 B2
(45) Date of Patent: Feb. 13, 2007

(54) ELECTRICAL TERMINAL ELEMENT

(75) Inventors: Andreas Urbaniak, Muenster (DE); Gregor Frimmersdorf, Solingen (DE); Eduard Cvasa, Bochum (DE)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 11/166,488

(22) Filed: Jun. 24, 2005

(65) Prior Publication Data

US 2005/0287878 A1 Dec. 29, 2005

(30) Foreign Application Priority Data

Jun. 28, 2004 (GB) ..... 0414319.4
Jan. 18, 2005 (EP) ..... 05000939

(51) Int. Cl.
*H01R 11/22* (2006.01)
*H01R 13/11* (2006.01)

(52) U.S. Cl. ..... 439/852; 439/856

(58) Field of Classification Search ..... 439/852, 439/856, 851, 862, 842, 843
See application file for complete search history.

(56) References Cited

U.S. PATENT DOCUMENTS

| | | | | |
|---|---|---|---|---|
| 3,697,934 | A * | 10/1972 | Merry | 439/748 |
| 5,607,328 | A * | 3/1997 | Joly | 439/852 |
| 5,620,345 | A | 4/1997 | Macioce et al. | 439/746 |
| 5,685,745 | A | 11/1997 | Yamamoto et al. | 439/706 |
| 5,947,777 | A | 9/1999 | Chaillot et al. | 439/852 |
| 6,386,928 | B2 * | 5/2002 | Kitamura | 439/852 |
| 6,439,935 | B2 * | 8/2002 | Saka et al. | 439/852 |
| 6,942,528 | B2 * | 9/2005 | Brake | 439/852 |
| 6,955,571 | B2 * | 10/2005 | Fujii | 439/856 |
| 2002/0065006 | A1 * | 5/2002 | Heimueller | 439/856 |
| 2003/0087551 | A1 * | 5/2003 | Okayasu et al | 439/587 |

* cited by examiner

*Primary Examiner*—Hien Vu
(74) *Attorney, Agent, or Firm*—David P. Wood

(57) ABSTRACT

The invention concerns an electrical terminal element with a crimp section and a socket section which forms a receiving chamber for a plug and which has a substantially rectangular cross-section, wherein in each case a locking projection is provided in the region of an insertion opening for the plug on opposed first side walls of the socket section. The invention further concerns a terminal element housing with at least one receiving chamber for receiving an electrical terminal element of this kind.

12 Claims, 3 Drawing Sheets

Fig.5.
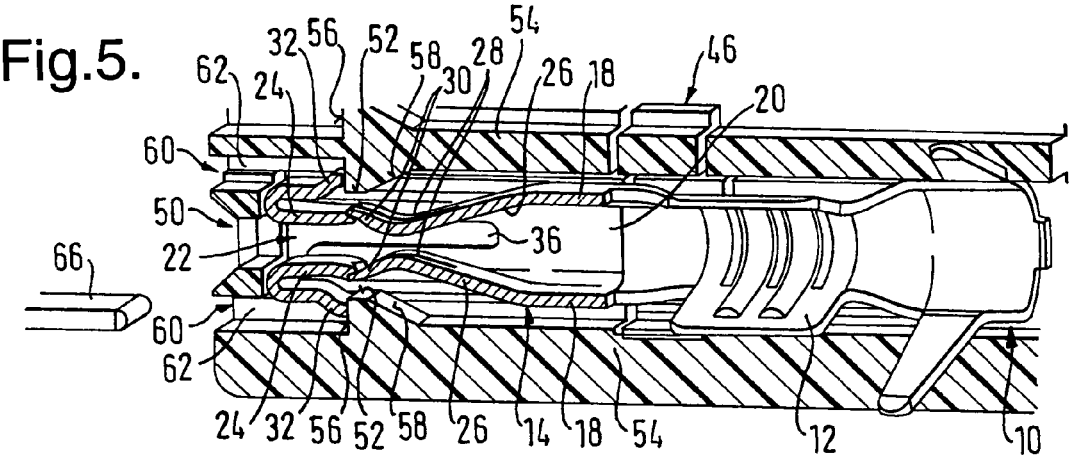
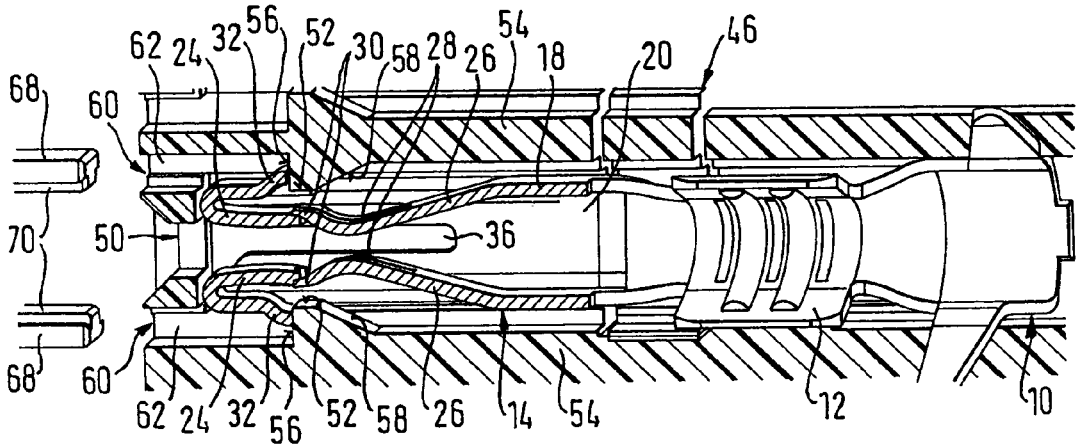
Fig.6.
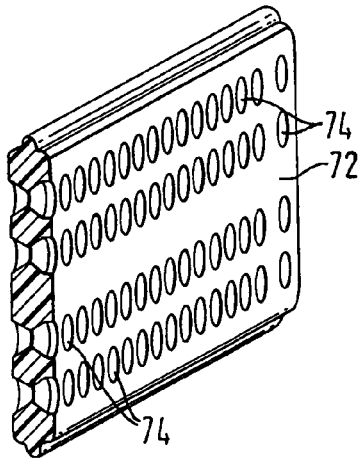
Fig.7.

ELECTRICAL TERMINAL ELEMENT

TECHNICAL FIELD

The invention concerns an electrical terminal element with a crimp section and a socket section which forms a receiving chamber for a plug and which has a substantially rectangular cross-section.

BACKGROUND OF THE INVENTION

An electrical terminal element of this kind is basically known. Typically, it is accommodated in a terminal element housing and fixed in the housing by means of locking elements. Known locking elements include, for example, latch lugs which protrude from side walls of the terminal elements and are bent over outwardly and which engage behind corresponding latch projections of the housing.

With a terminal element of this kind, it proves to be problematic that the latch lugs can withstand only minor pull or push forces, so that in case of elevated forces there is a risk of the terminal elements being pulled out of the housing and being damaged in the process. If the terminal element housing is provided with a seal on one side on which the terminal element is introduced into the housing, in the case of sharp-edged latch lugs there is the added disadvantage that the seal is damaged during introduction of the terminal elements into the housing.

A further known terminal element of the kind mentioned hereinbefore has at least one non-deformable locking projection. In order that such a terminal element can be introduced into a terminal element housing, it is required that latch projections of the housing can be displaced by the locking projections during insertion of the terminal element. The latch projections must therefore be spring-mounted, e.g. by means of spring arms arranged in the housing. The provision of spring arms of this kind leads to increased size of the terminal element housing, which has a particularly adverse effect in particular when the housing is provided for receiving several terminal elements.

SUMMARY OF THE INVENTION

It is the object of the invention to provide an electrical terminal element which can be locked in the terminal element housing with increased safety and with minimum space requirements.

To achieve the object, an electrical terminal element with the characteristics of claim 1 is provided.

The terminal element according to the invention includes a crimp section and a socket section which forms a receiving chamber for a plug and which has a substantially rectangular cross-section. Here, in each case a locking projection which is not deformable when used as intended is provided in the region of an insertion opening for the plug on opposed first side walls of the socket section. Opposed second side walls of the socket section have in each case a longitudinal opening extending in the direction of insertion.

The locking projections of the terminal element according to the invention are not deformable when used as intended, i.e. they display elevated mechanical stability. The locking projections are, in other words, designed in such a way that, in the case of a terminal element arranged and locked in a terminal element housing, they can be supported on correspondingly designed latch projections of the terminal element housing, but are then not themselves deformed, e.g. bent over, by the latch projections when an elevated force is applied in the direction of insertion to the respective terminal element. The terminal element consequently can be locked particularly securely in the terminal element housing and protected in particular against accidental pushing out of the terminal element housing in case of elevated insertion forces, or accidental pulling out of the terminal element housing in case of elevated pulling forces.

Due to the fact that the opposed second side walls of the socket section each have a longitudinal opening extending in the direction of insertion, the socket section can be compressed in particular in the region of the insertion opening and hence in the region of the locking projections. The locking projections can therefore be deflected transversely to the direction of insertion and in particular moved towards each other, and the width of the terminal element can be reduced as a result.

This makes it possible to move the terminal element and in particular the non-deformable locking projections past rigid latch projections of the housing when the terminal element is introduced into the terminal element housing.

Preferably, the latch projections and/or the locking projections are constructed like ramps in such a way that, when the terminal element is slid past the latch projections, the locking projections run up the latter and the socket section is compressed as a result. As soon as the locking projections overcome the latch projections, the socket section snaps apart again, so that the locking projections engage behind the latch projections and the terminal element is fixed in the terminal element housing.

Due to the fact that it is not the locking projections, but the socket section as a whole that is made deformable and exhibits a certain spring property, it is not necessary to design or arrange the latch projections of the terminal element housing in spring fashion. In particular, no spring arms have to be provided in order to mount the latch projections deflectably in the housing.

Instead, the latch projections can be integrally formed directly on a wall of the terminal element housing which defines a chamber for the terminal element. This makes it possible to construct the chamber with a minimum width adapted to the terminal element and so ultimately to make a particularly compact terminal element housing.

Advantageous embodiments of the terminal element according to the invention can be found in the subsidiary claims, the description and the drawings.

According to a preferred embodiment of the terminal element, the longitudinal openings extend along a longitudinal centre axis of the second side walls and/or, starting from the insertion opening, over a length of more than half the socket section. With such a design of the longitudinal openings, the socket section is at least in one region divided into two socket section halves separated from each other by the longitudinal openings. The longitudinal openings allow movement of the socket section halves towards each other so that, when the terminal element is introduced into the terminal element housing, the socket section can be compressed not only without damaging the terminal element, but also particularly easily. This makes it possible to move the locking projections with relatively little effort past the latch projections of the housing, in order to latch in behind the latch projections.

Advantageously, the locking projections are three-dimensional outward stampings of the first side walls. Due to the design of the locking projections as outward stampings, the locking projections can be made in a particularly simple manner, namely, by a simple stamping process. The three-dimensionality of the locking projections imparts elevated rigidity to the locking projections, which substantially contributes to the fact that the locking projections are not deformable when used as intended. The locking projections thus ensure even more reliable locking of the terminal element in the terminal element housing.

The locking projections can be constructed like ramps on their side facing towards the insertion opening. This facilitates introduction of the terminal element into the terminal element housing still further because, due to their ramp-like construction, the locking projections can run up the latch projections of the housing particularly well and so lead to compression of the socket section. Furthermore, the ramp-like locking projections also contribute to careful expansion of an opening of a seal provided if occasion arises on the terminal element housing.

Preferably, the locking projections are spaced apart from the edges which form the respective first side wall with the adjacent second side walls. In particular in the case of a seal with an opening which has a round cross-section, when a terminal element is passed through the opening, particularly high stresses in the sealing material arise in the region of the edges of the terminal element. The distance from the locking projections to the edges contributes to reducing the stresses in the region of the edges and so avoiding tearing of the sealing material in the region of the edges. Due to the distance from the locking projections to the edges, the terminal element can consequently be passed even more carefully through an opening in a seal of the terminal element housing.

The edges at which the side walls of the socket section abut against each other are preferably rounded. As a result, initial tearing of the sealing material when the terminal element is passed through the seal is avoided even better. The terminal element can, in other words, be passed even more carefully through the seal.

It is particularly advantageous if guide lugs which protrude from the first side walls are bent over into the receiving chamber in the region of the insertion opening. The guide lugs facilitate introduction of the plug into the terminal element and furthermore prevent damage to spring contact arms provided for contacting the plug when the plug is wrongly inserted.

Preferably, in each case a spring contact arm protrudes from the first side walls for contacting a plug held in the socket section. The terminal element has, in other words, two mutually opposed spring contact arms by which the plug can be contacted on both sides. The plug is thus acted upon not just symmetrically, but also with an elevated contact force. As a result, reliable mechanical and electrical contacting of the plug is durably ensured.

The spring contact arms can be biased towards each other and be supported on the guide lugs when the plug is not inserted in the socket section. Due to the bias of the spring contact arms, the force which the spring contact arms apply to a plug inserted in the socket section is still further increased. At the same time the spring contact arms are held at a predetermined distance from each other by the guide lugs when the plug is not inserted, so that the force which is to be applied to expand the spring contact arms when the plug is introduced into the socket section, is minimised.

The terminal element is preferably a stamped and bent component constructed in one piece and so can be made with low economic expenditure.

A further subject of the invention is moreover a terminal element housing with at least one receiving chamber for receiving an electrical terminal element of the kind mentioned above, wherein two rigid latch projections behind which the locking projections of the terminal element can engage for fixing the terminal element in the receiving chamber extend into the receiving chamber and wherein a seal with an opening for introducing the terminal element into the receiving chamber is provided on one side of the terminal element housing which is opposite an insertion opening of the terminal element housing for a plug.

As the socket section of the terminal element according to the invention can be compressed as a whole on account of its longitudinal openings, the terminal element housing according to the invention can be provided with rigid, i.e. non-deformable and also not spring-mounted, latch projections. Consequently no additional spring arms have to be provided for movable mounting of the latch projections, so that the receiving chamber can be optimally adapted to the size of the terminal element. This allows a more compact design of the terminal element housing, which is advantageous particularly when the terminal element housing includes a plurality of receiving chambers.

The seal is provided on the side of the terminal element housing facing away from the insertion opening for the plug. This side is hereinafter referred to as the rear side of the terminal element housing. Due to the seal, a region adjoining the rear side of the terminal element housing is separated from the receiving chamber. If the terminal element housing is integrated in a carrier structure, then an interior of the carrier structure adjoining the rear side of the terminal element housing is protected by the seal from external influences, e.g. moisture or dust.

According to an advantageous embodiment of the terminal element housing, a guide channel adjacent to the insertion opening for the plug is provided for introducing a test contact into the terminal element housing, which in particular runs parallel to the direction of insertion of the plug and/or extends as far as one of the latch projections. Due to the separate guide channel, it is possible to test the function of the terminal element without a plug having to be introduced into the socket section of the terminal element in return. This makes it possible to deliver to a customer a terminal element housing of which the terminal element has been tested for its function, but not fitted with a plug before delivery to the customer.

Preferably, guide channels adjacent to the insertion opening for the plug are provided for introducing release elements into the terminal element housing, which are arranged on opposite sides of the insertion opening for the plug and in particular run parallel to the direction of insertion of the plug and/or extend as far as the latch projections. The guide channels allow release of a terminal element locked in the housing, in the event that the terminal element is to be removed from the terminal element housing. In this case, it is only necessary to push rod-shaped release elements into the guide channels, to release the terminal element.

The guide channels are arranged in such a way that the locking projections of the terminal element can be acted upon by the inserted release elements, and the socket section of the terminal element can be compressed to such an extent that the locking projections can move past the latch projections of the housing when the terminal element is pulled out of the terminal element housing.

It is particularly advantageous if at least one of the guide channels for the release elements includes in at least one region the guide channel for the test contact. In this case no separate guide channels are provided for the test contact on the one hand and the release elements on the other hand, but at least one of the guide channels for the release elements performs a dual function by serving not only to guide a release element, but also to guide the test contact.

BRIEF DESCRIPTION OF THE INVENTION

Below, the terminal element according to the invention and the terminal element housing according to the invention are described purely by way of example with the aid of an advantageous embodiment each, with reference to the drawings. They show:

FIG. 5 is the terminal element of FIG. 3 arranged in the terminal element housing, with a test contact;

FIG. 6 is the terminal element of FIG. 3 arranged in the terminal element housing, with two release elements; and FIG. 7 is a perspective partial view of a seal for sealing off a rear side of the terminal element housing.

DESCRIPTION OF THE EMBODIMENT

Figure 1:
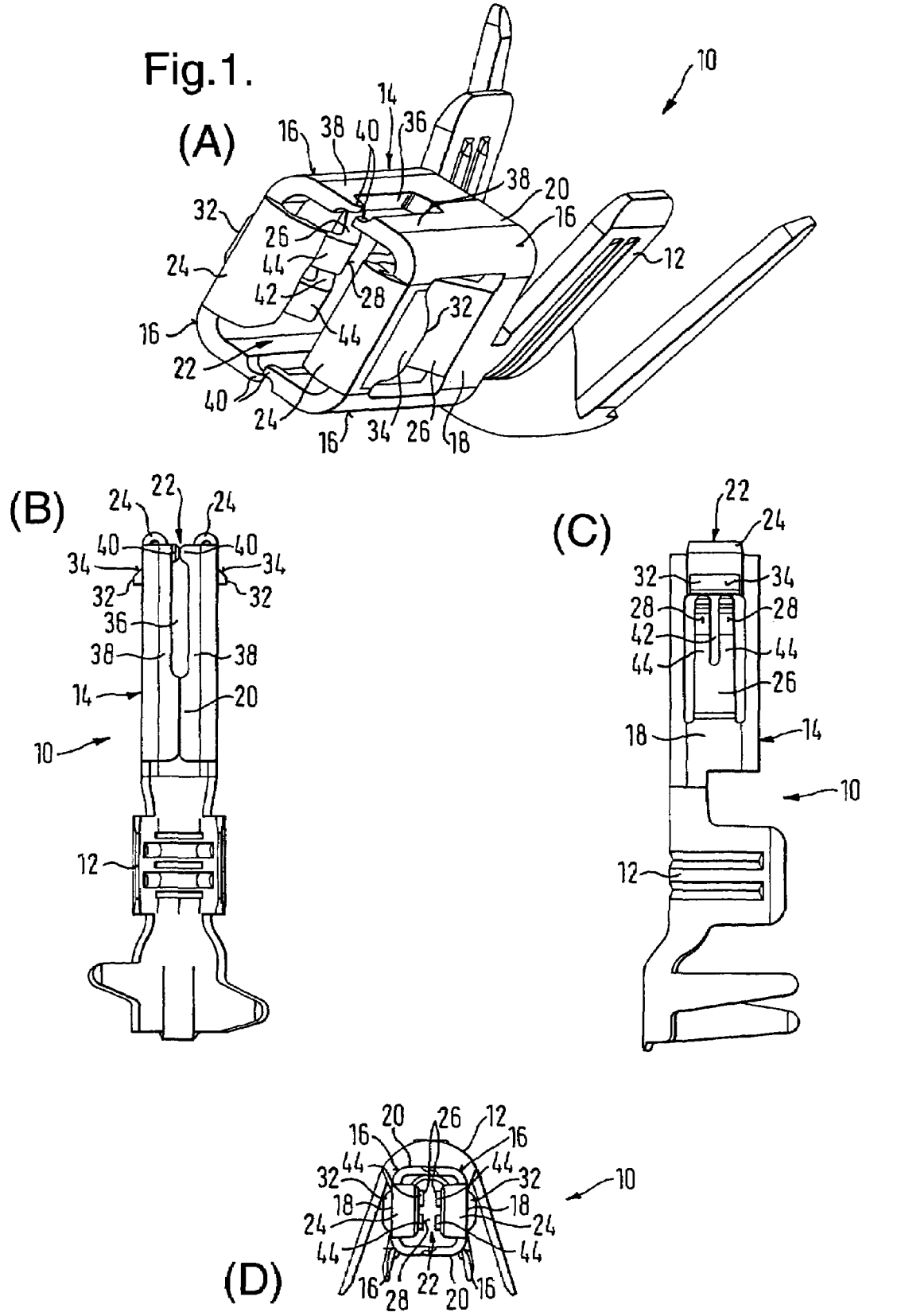
FIG. 1 is (A) a perspective view, (B) a top view, (C) a side view and (D) a front view of a terminal element according to the invention.
Figure 2:
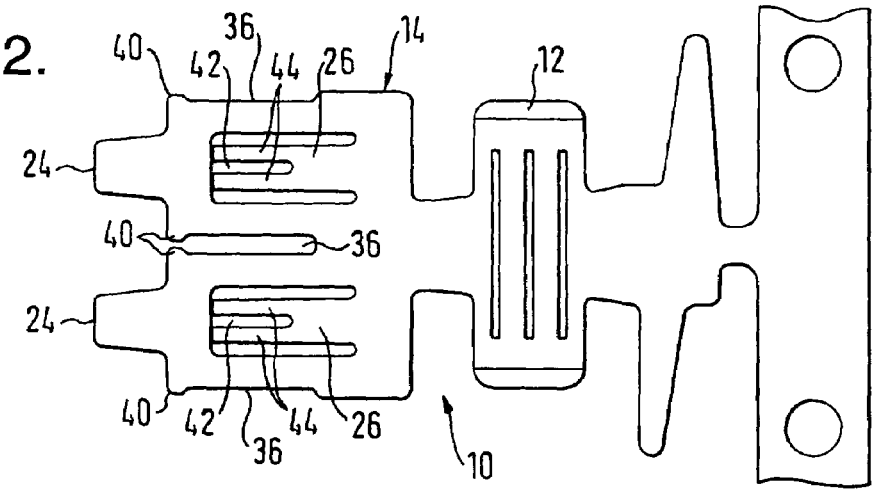
FIG. 2 is the terminal element of FIG. 1 in a stamped-out, but not yet bent-over state.

The terminal element 10 according to the invention as in the embodiment shown is constructed in one piece as a stamped, bent component. FIG. 1 shows different views of the terminal element 10 in the final state, while FIG. 2 shows the terminal element 10 in the stamped-out, but not yet bent-over state.

The terminal element 10 includes a crimp section 12 for connection of the terminal element 10 to an electrical wire, as well as a socket section 14 which forms a receiving chamber for a plug, not shown.

The socket section 14 has a rectangular and almost square cross-section, the longitudinal edges 16 of the socket section 14 being rounded. With respect to its longitudinal centre planes, the socket section 14 is designed substantially symmetrically, i.e. in each case opposed side walls 18, 20 of the socket section 14 are designed substantially the same.

On its front side the socket section 14 has an insertion opening 22 for inserting the plug. From opposite first side walls 18 protrude guide lugs 24 which are bent over inwardly in the region of the insertion opening 22 and in at least one section extend into the receiving chamber for the plug parallel to the direction of insertion of the plug. The guide lugs 24 not only facilitate insertion of the plug, but also ensure correct insertion of the plug.

In a rear region of the socket section 14, i.e. facing towards the crimp section 12, a spring contact arm 26 protrudes from each first side wall 18. The spring contact arms 26 extend in the direction of the insertion opening 22 and in the process converge on each other. In a contact region 28 which is provided for mechanical and electrical contacting of the plug introduced into the socket section, the spring contact arms 26 are a minimum distance apart from each other. Starting from the contact region 28, the spring contact arms 26 diverge again in the direction of their free ends 30.

The spring contact arms 26 are biased towards each other. Here, when the plug is not inserted in the socket section 14, the spring contact arms 26 are supported on the guide lugs 24 in the region of their free ends 30, and are kept at a distance by the guide lugs 24. The spring contact arms 26 are thus a predetermined distance apart from each other in the contact region 28. Consequently only minimum force has to be applied in order to move the spring contact arms 26 apart upon insertion of the plug. Insertion of the plug in the socket section 14 is thus made easier.

The spring contact arms 26 have in each case a longitudinal slot 42 which, starting from a region located behind the contact region 28, extends in the direction of the free ends 30 of the spring contact arms 26. Due to the longitudinal slots 42, each spring contact arm 26 includes two separate contact sections 44 in the contact region 28, so that a plug inserted in the socket section 14 can be contacted in four regions separate from each other. As a result, the reliability of both mechanical and electrical contacting of the plug is considerably increased.

In the region of the insertion opening 22, in each case a locking projection 32 is formed on each first side wall 18. The locking projections 32 are three-dimensional outward stampings of the first side walls 18 and have a forwardly facing inclined surface 34. As can be seen in particular in FIG. 1B, the locking projections 32 project laterally from the first side walls 18 of the socket section 14, each forming a rearwardly ascending ramp.

On account of their three-dimensional construction, the locking projections 32 are not deformable when used as intended and in particular under the action of forces acting counter to the direction of insertion.

The locking projections 32 do not extend over the whole width of the first side walls 18, but are spaced apart from the rounded longitudinal edges 16 in which the first side walls 18 merge with the second side walls 20. Further, the inclined surfaces 34 of the locking projections 32 do not have a sharp edge either in their regions facing towards the insertion opening 22 or in their regions facing towards the longitudinal edges 16, i.e. the inclined surfaces 34 merge progressively with the associated side wall 18 with a corresponding curvature.

The second side walls 20 each have a longitudinal opening 36 which, starting from the insertion opening 22, extends centrally along the respective second side wall 20, this being over more than half and almost over two-thirds of the length of the socket section 14. By the longitudinal openings 36, the socket section 14 is divided into two socket section halves 38.

In the region of the insertion opening 22, the longitudinal openings 36 are defined by lug-like extensions 40 of the side wall sections defining the longitudinal openings 36, which extensions 40 point towards each other. The lug-like extensions 40 are designed so as to overlap each other when the socket section halves 38 are compressed.

The longitudinal openings 36 allow compression of the socket section halves 38, as a result of which the locking projections 32 are movable transversely to the direction of insertion.

Figure 3:
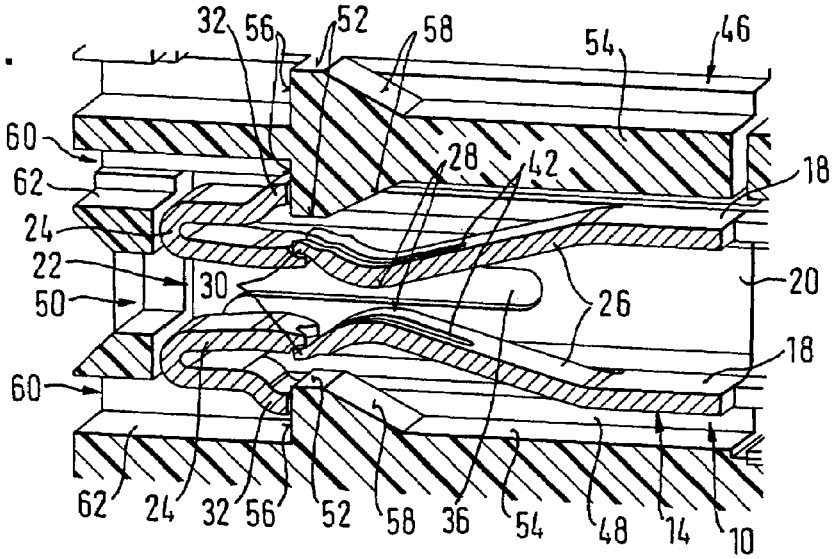
FIG. 3 is a cross-sectional view of the terminal element of FIG. 1 arranged in a terminal element housing.

FIGS. 3, 5 and 6 show the terminal element 10, as arranged in a terminal element housing 46. The terminal element housing 46 is an injection moulding formed from a plastic material, which has several chambers 48 for receiving a terminal element 10 each. The chambers 48 are arranged adjacent to each other and in several rows one above the other.

Each chamber 48 has an insertion opening 50 for inserting a plug. Further, in each case two rigid latch projections 52 extend in the region of the insertion opening 50 into each chamber 48, which serve to lock the terminal elements 10 in the chambers 48. The latch projections 52 of each chamber 48 are arranged on opposite walls 54 defining the chamber 48 and have a ramp-like shape. Each latch projection 52 includes, on its front side facing towards the insertion opening 50, a stop face 56 oriented transversely to the direction of insertion of the plug, and on its rear side facing away from the insertion opening 50, a descending inclined surface 58.

For insertion of a terminal element 10 in a chamber 48 of the terminal element housing 46, the terminal element 10 is pushed into the latter from the rear, i.e. on the rear side of the terminal element housing 46 facing away from the insertion opening 50 for the plug.

If the locking projections 32 of the terminal element 10 move into the region of the latch projections 52 of the terminal element housing 46, then the inclined surfaces 34 of the locking projections 32 run up the inclined surfaces 58 of the latch projections 52. The longitudinal openings 36 in the process allow compression of the socket section 14 in such a way that upon insertion of the terminal element 10 in the chamber 48 the socket section halves 38 are compressed to such an extent that the locking projections 32 can move past the latch projections 52.

As soon as the locking projections 32 have overcome the latch projections 52, the compressed socket section halves 38 spring apart again, so that the locking projections 32 engage behind the latch projections 52 on their stop faces 56. The locking projections 32, in other words, latch in behind the latch projections 52, with the result that the terminal element 10 is fixed in the terminal element housing 56.

Due to the fact that the locking projections 32 of the terminal element 10 are deflectable, it is not necessary to make the latch projections 52 of the terminal element housing 46 deformable or spring-mount them. The latch projections 52 can therefore protrude directly from the walls 54 defining the chambers 48, as shown in FIGS. 3, 5 and 6. This makes it possible to arrange the chambers 48 a minimum distance apart from each other, resulting in a particularly compact design of the terminal element housing 46.

Due to the fact that the latch projections 52 are of rigid construction and also the locking projections 32 are not deformable when used as intended, the latching of terminal element 10 and terminal element housing 46 withstands particularly high push and pull forces. The terminal element 10 is consequently mounted particularly securely in the terminal element housing 46.

Figure 4:
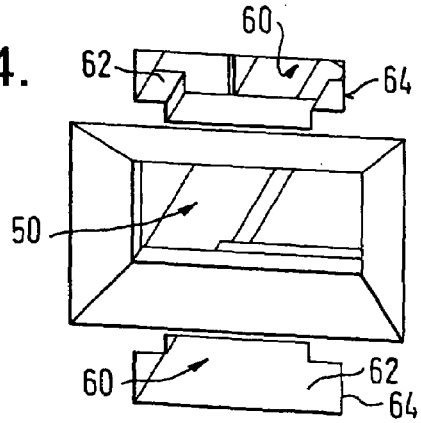
FIG. 4 is several insertion openings of the terminal element housing of FIG. 3.

As can be seen from FIGS. 3 to 6 and in particular FIG. 4, each chamber 48 of the terminal element housing 46 is provided with two additional insertion openings 60 which are arranged on opposite sides of the insertion opening 50 for the plug. The adjacent insertion openings 60 allow access to guide channels 62 which extend parallel to the direction of insertion and end at the stop face 56 of the latch projections 52. The adjacent insertion openings 60 in each case have a T-shaped cross-section, wherein the crossbar of the T-profile forms in each case the region 64 of the adjacent insertion openings 60 facing away from the insertion opening 50 for the plug.

The transverse region 64 of the adjacent insertion openings 60 serves to introduce a rod-shaped test contact 66, the cross-section of which is adapted to the profile of the transverse region 64 (FIG. 5). By the transverse region 64 of an insertion opening 60, the test contact 66 can be moved along the corresponding guide channel 62 up to the respective latch projection 52 and in the process brought into contact with the corresponding locking projection 32 of a terminal element 10 arranged in the terminal element 46.

This allows checking of electrical function of the terminal element 10 in the terminal element housing 46, without a plug having to be introduced into the socket section 14 of the terminal element 10. A terminal element housing 46 provided with a terminal element 10 can thus, in spite of checking of function of the terminal element 10, be delivered to a customer with to a certain extent a "virgin" terminal element 10.

The adjacent insertion openings 60 further allow the introduction of rod-shaped release elements 68 into the guide channels 62 (FIG. 6). The release elements 68 have a T-shaped profile which is adapted to the T-shaped cross-section of the insertion openings 60. The release elements 68 too can be moved up to the latch projections 52.

In the region of the latch projections 52, the sections 70 of the release elements 68 pointing towards each other, i.e. the sections 70 oriented perpendicularly to the crossbar of the T-profile, run up the inclined surfaces 34 of the locking projections 32. As a result, the socket section halves 38 of the terminal element 10 are compressed and the locking projections 32 are deflected to such an extent that they can move past the latch projections 52 of the terminal element housing 46. The release elements 68 thus allow release of the terminal element 10, so that the latter can be removed from the terminal element housing 46.

In FIG. 7 is shown a sealing mat 72 for sealing a rear side of the terminal element housing 46. The sealing mat 72 has a suitable sealing material, for example, a rubber, silicone or felt material. In the sealing mat 72 are provided several substantially circular openings 74, the arrangement of which is adapted to the arrangement of the chambers 48 for receiving terminal elements 10 in the terminal element housing 46. The terminal elements 10 can be introduced through the openings 74 into the respective chambers 48.

Upon passage of a terminal element 10 through an opening 74 in the sealing mat 72, the opening 74 is expanded. Here, basically there is the risk of initial tearing of the sealing mat 72. Due to the rounded design of the longitudinal edges 16 and locking projections 32 and also due to the distance from the locking projections 32 to the longitudinal edges 16, the risk to the sealing mat 72 is however considerably reduced. This allows particularly careful insertion of the terminal element 10 in the terminal element housing 46. In particular a terminal element 10 can, for example, for testing purposes, be passed repeatedly through a corresponding opening 74 in the sealing mat 72, without the sealing mat 72 tearing in the process.

The invention claimed is:

1. An electrical terminal element having a socket section which forms a receiving chamber for receiving a plug and which has a substantially rectangular cross-section comprising opposed first side walls and opposed second side walls, wherein each of the opposed first side walls of the socket section has a locking projection which is not deformable, each of the locking projections being located in a front region of an insertion opening of the receiving chamber for the plug and wherein the opposed second side walls of the socket section each have a longitudinal opening starting from the insertion opening and extending in a direction of insertion of the socket section into a receiving chamber of a terminal element housing, wherein the longitudinal openings extend centrally alone a longitudinal axis of the respective opposed second side walls and provide socket section parts that are compressible toward each other, and wherein one of the locking projections is provided on each of the socket section parts that are compressible toward each other.

2. The electrical terminal element according to claim 1, wherein the longitudinal openings extend over a length of more than half the socket section.

3. The electrical terminal element according to claim 1, wherein the locking projections are three-dimensional outward stampings of the opposed first side walls which have ramps on their side facing toward the insertion opening.

4. The electrical terminal element according to claim 1 wherein the locking projections are spaced apart from rounded edges forming the respective first side walls with the adjacent respective second opposed side walls.

5. The electrical terminal element according to claim 1 wherein guide lugs which protrude from the first side walls are bent over into the receiving chamber in the region of the insertion opening.

6. The electrical terminal element according to claim 1 wherein a spring contact arm protrudes from each of the opposed first side walls for contacting a plug held in the socket section.

7. The electrical terminal element according to claim 6, wherein the spring contact arms are biased towards each other and supported on the guide lugs when the plug is not inserted in the socket section.

8. A terminal element housing with at least one receiving chamber for receiving an electrical terminal element according to claim 1 wherein two rigid latch projections behind which the locking projections of the electrical terminal element can engage for fixing the terminal element in the receiving chamber extend into the receiving chamber and wherein a sealing mat with an opening for introducing the terminal element into the receiving chamber is provided on one side of the terminal element housing which is opposite an insertion opening of the terminal element housing for the plug.

9. The terminal element housing according to claim 8, wherein a guide channel adjacent to the insertion opening for the plug is provided for introducing a test contact into the terminal element housing, the guide channel being parallel to the direction of insertion of the plug and extending as far as one of the latch projections.

10. The terminal element housing according to claim 8 wherein guide channels are provided adjacent to each side of the insertion opening for the plug for introducing release elements into the terminal element housing, the guide channels being arranged on opposite sides of the insertion opening for the plug and parallel to the direction of insertion of the plug and extending as far as the latch projections, and wherein the lock projections have ramps on their side facing toward the insertion opening.

11. The terminal element housing according to claim 9 wherein at least one of the guide channels for the release elements is provided for introducing a test contact into the terminal housing.

12. The electrical terminal element according to claim 1 wherein the longitudinal openings are defined in part by lug-like extensions that overlap each other when the socket section parts are compressed toward each other.

* * * * *